US011198024B2

(12) United States Patent
Simpkins et al.

(10) Patent No.: US 11,198,024 B2
(45) Date of Patent: Dec. 14, 2021

(54) CONTROLLED DESCENT SAFETY SYSTEMS AND METHODS

(71) Applicant: Bailout Systems, Inc., Louisville, KY (US)

(72) Inventors: Haskell Simpkins, Cincinnati, OH (US); Ben T. Krupp, Wyoming, OH (US); Patrick T. Henke, Hamilton, OH (US); Michael A. Ragsdale, Cincinnati, OH (US)

(73) Assignee: Bailout Systems, Inc., Cincinnati, OH (US)

( * ) Notice: Subject to any disclaimer, the term of this patent is extended or adjusted under 35 U.S.C. 154(b) by 366 days.

(21) Appl. No.: 16/258,103

(22) Filed: Jan. 25, 2019

(65) Prior Publication Data

US 2019/0232093 A1 Aug. 1, 2019

Related U.S. Application Data

(60) Provisional application No. 62/622,632, filed on Jan. 26, 2018.

(51) Int. Cl.
*A62B 1/10* (2006.01)
*B66D 5/18* (2006.01)
(Continued)

(52) U.S. Cl.
CPC ..... *A62B 1/10* (2013.01); *A62B 1/14* (2013.01); *B66D 1/42* (2013.01); *B66D 1/7452* (2013.01);
(Continued)

(58) Field of Classification Search
CPC .... A62B 1/10; A62B 1/14; B66D 1/42; B66D 1/7452; B66D 5/16; B66D 5/18
See application file for complete search history.

(56) References Cited

U.S. PATENT DOCUMENTS 554,587 A * 2/1896 Evans ..... A62B 1/14 182/192
2,544,964 A * 3/1951 Phelan ..... A62B 1/14 182/193

(Continued)

FOREIGN PATENT DOCUMENTS

DE 2831449 A1 * 1/1980 ..... A62B 1/10
GB 999552 A * 7/1965 ..... A62B 1/10

*Primary Examiner* — Colleen M Chavchavadze
(74) *Attorney, Agent, or Firm* — Ulmer & Berne LLP

(57) ABSTRACT

A velocity control device for controlling the velocity of a load on a flexible tension member. The device can include a chassis having a chassis peripheral surface, with a portion of the chassis peripheral surface defining an exit aperture. The device can also include a capstan, the capstan having a proximal face joined to the chassis and a distal face separated at a distance from the proximal face. A peripheral capstan surface can be tapered from a greatest diameter near the distal face to a smallest diameter near the proximal face. The device can include a throttle, the throttle being attached to the chassis. The throttle can an interior surface defining an opening through which the tension member can pass with the interior surface being in at least partial contact with the tension member. Heat produced by kinetic energy in the flexible tension member is transferred to the throttle, and the change in system internal energy produces work in the form of a drag force on the flexible tension member.

10 Claims, 16 Drawing Sheets

(51) Int. Cl.

| | |
|---|---|
| ***B66D 1/74*** | (2006.01) |
| ***B66D 1/42*** | (2006.01) |
| ***B66D 5/16*** | (2006.01) |
| ***A62B 1/14*** | (2006.01) |

(52) U.S. Cl.
CPC ..... *B66D 5/16* (2013.01); *B66D 5/18* (2013.01); *B66D 2700/0108* (2013.01)

(56) References Cited

U.S. PATENT DOCUMENTS

| | | | | | |
|---|---|---|---|---|---|
| 4,145,027 | A * | 3/1979 | Brimo | A62B 1/10 | 182/193 |
| 4,494,629 | A * | 1/1985 | Raeburn | A62B 1/14 | 182/7 |
| 6,814,185 | B1 * | 11/2004 | Ostrobrod | A62B 1/14 | 182/191 |
| 7,055,651 | B2 * | 6/2006 | Klingler | A62B 1/14 | 182/193 |
| 7,055,653 | B2 * | 6/2006 | Hamada | A62B 1/14 | 182/193 |
| 7,131,515 | B2 * | 11/2006 | Gartsbeyn | A62B 1/14 | 182/192 |
| 10,918,892 | B2 * | 2/2021 | Dickson | A62B 1/14 | |
| 2019/0084813 | A1 * | 3/2019 | Farkash | B61H 9/02 | |

* cited by examiner

CONTROLLED DESCENT SAFETY SYSTEMS AND METHODS

REFERENCE TO RELATED APPLICATION

The present application is a U.S. non-provisional application that claims the priority benefit of U.S. provisional patent application Ser. No. 62/622,632, filed Jan. 26, 2018, and hereby incorporates the same application by reference in its entirety.

TECHNICAL FIELD

Embodiments of the technology relate, in general, to controlled velocity devices, and in particular to personal controlled descent control devices.

BACKGROUND

There arise situations when a line-constrained load should experience a controlled velocity. For example, in an emergency situation, such as during a fire in a tall building, escape from an elevated position becomes necessary, such as by exiting a window in an upper floor of the building. Use of a standard descent rope to escape from an elevated position is very dangerous, particularly to those not versed in rappelling techniques, where providing an improved safety device would be advantageous.

DETAILED DESCRIPTION

Figure 1:
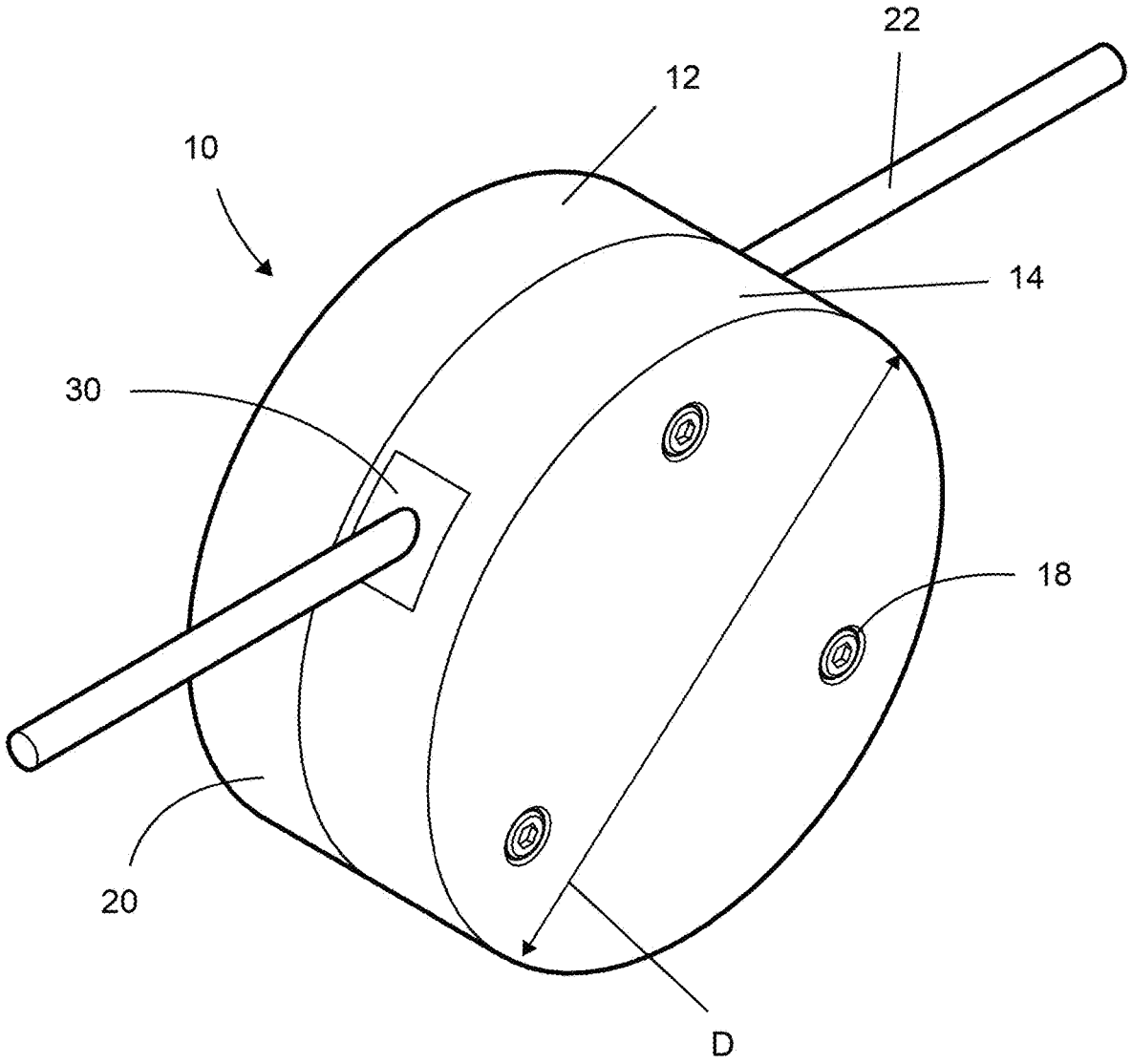
FIG. 1 is a perspective view of a controlled descent device according to one embodiment.

Certain embodiments are hereinafter described in detail in connection with the views and examples of FIGS. 1-16, wherein like numbers refer to like elements throughout the views.

Various non-limiting embodiments of the present disclosure will now be described to provide an overall understanding of the principles of the structure, function, and use of the apparatuses, systems, methods, and processes disclosed herein. One or more examples of these non-limiting embodiments are illustrated in the accompanying drawings. Those of ordinary skill in the art will understand that systems and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

Reference throughout the specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment," or "in an embodiment" in places throughout the specification are not necessarily all referring to the same embodiment. Furthermore, the particular features, structures or characteristics may be combined in any suitable manner in one or more embodiments.

The examples discussed herein are examples only and are provided to assist in the explanation of the apparatuses, devices, systems and methods described herein. None of the features or components shown in the drawings or discussed below should be taken as mandatory for any specific implementation of any of these the apparatuses, devices, systems or methods unless specifically designated as mandatory. For ease of reading and clarity, certain components, modules, or methods may be described solely in connection with a specific figure. Any failure to specifically describe a combination or sub-combination of components should not be understood as an indication that any combination or sub-combination is not possible. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented but instead may be performed in a different order or in parallel.

The device disclosed herein is useful as a load lowering velocity controller. However, the device can operate broadly as a velocity control mechanism for any load experiencing a force tending to move or accelerate it. For example, the device disclosed herein can be used to control the velocity of an ascending load, for example, an ascending weather balloon. Likewise, the device disclosed herein can be used to control the relative velocity of a laterally moving vehicle, for example, a trailer that has come loose from a towing vehicle. The device will be disclosed in detail herein as a load lowering velocity controller of the type useful in lowering people out of buildings in emergency situations.

Controlled descent from emergency situations may be accomplished by a skilled practitioner, such as a firefighter, trained in rappelling. To an untrained, young or infirm individual, exiting an emergency situation with a mere rope can be extremely dangerous. Additionally, even trained responders, such as firefighters, may find themselves in situations where they are injured, carrying additional weight such as while rescuing others, or lack the equipment necessary for a controlled descent. Further, the practitioner may require use of his or her hands during the descent to operate equipment such as a firearm or manipulate themselves or another payload. The controlled descent device disclosed herein can be utilized in a hands-free operation by trained and untrained persons alike.

Embodiments described herein can be less expensive, have less mass, be less bulky, and can be easier to maintain than powered winches or other existing safety systems. Embodiments described herein may be useful in power outages, such as those frequently occurring during fires or disasters, where an external power source may not be required. Embodiments described herein can be operated automatically, without hand braking, in a compact and cost-effective manner. Embodiments of the system can be used for a variety of different weights of users without the need to adjust for different weights. For example, a firefighter within an average weight range could attach a device described herein and use the device to safely descend from a building without being required to manipulate the device based on his or her weight or otherwise tailor the system during descent. In an embodiment, a device described herein can be designed based on other factors related to weight, such as the waist size or the clothing sizes of a user. In general, it is contemplated that controlled descent devices can be designed and manufactured for predetermined load ranges, including weight ranges for persons such as firefighters.

In accordance with an example embodiment, multiple technologies can be incorporated into a single descent control unit that can be suitably fabricated as a portable and/or wearable system. The system, in one embodiment, as discussed below with respect to the system shown FIG. 4, can allow a user, after confirmation of device operation within the desired controlled velocity range, to simply clip or otherwise attach the device to himself, attach a free end of the flexible tension member, such as a rope, onto a relatively fixed position and jump to a place of safety while descending at a range of predetermined rates.

In accordance with an example embodiment, the controlled descent device can be permanently mounted in strategic locations, as discussed below with respect to the system shown in FIG. 5. In this example, a device can be ready for use by a user, after confirmation of device operation within the desired controlled velocity range, who clips himself onto a free end of the flexible tension member associated with the device.

In an embodiment, the device disclosed herein can utilize moving parts to adjust the velocity control profile, prior to or during use. Moving parts can be used to manipulate the gain of the capstan 28 or the force generated by the throttle 30. Parts can be moved by way of user input, or by mechanisms powered from the kinetic energy of the payload, or actuated by forces present in the device, such as tensile force in the flexible tension member. In an embodiment, the device disclosed here in can be used by a person, after confirmation of device operation within the desired controlled velocity range, without the person interacting with the device in any way to effect controlled descent. That is, the device can be operable for use in lowering a load, such as a person, in a controlled manner with the person not needing to manipulate the device for it to work properly. In an embodiment, for example, an untrained person, and even an unconscious person, can be lowered at a controlled velocity range in a controlled manner using the device disclosed herein. As used herein, "controlled descent" includes translation of an object within a controlled velocity range, including constant velocity descent of a load under the force of gravity.

As described herein, the device can be a relatively compact design suitable for attachment and operation from a belt, harness, or bodice, or other suitable load distributing garment of a wearer. Additionally, the device can be substantially enclosed and protected from the elements for operation in harsh environments.

Referring to FIG. 1, disclosed is one embodiment of a controlled descent device 10 having a housing 12. The housing is any structure for mounting and/or protecting the capstan and flexible tension member. The housing can be made of two or more parts joined together to make an enclosure for a capstan 28. The capstan 28 is described more fully with respect to FIGS. 2 and 3 below. A chassis 16 of the housing 12 can have joined thereto the capstan 28. The chassis 16 can be a portion of the controlled descent device 10 that on one side thereof can have a connection member (not shown), such as a clip for clipping to a safety harness of a user, and on another side thereof have disposed thereon the capstan 28. A housing cover 14 can be joined to the chassis 16 in any suitable manner, including screw connections 18 as shown in FIG. 1. The housing cover 14 of the housing 12 can have joined thereto the capstan 28. In an embodiment, the capstan 28 can be joined to or can be integral with either the chassis 16 or housing cover 14. By way of example, the capstan can be integral with another part, for example the chassis, the chassis and capstan can be machined out of a single piece of suitable material, such as aluminum for example. In an embodiment, the capstan 28 could be partitioned into multiple parts, with a portion of the capstan being integral to the chassis 16 and the remaining portion integral to the housing cover 14.

While the housing shown in FIG. 1 has a cylindrical shape, the housing can be other shapes, including generally rectangular, or box-shaped, pentagonal, hexagonal, octagonal, and other polygonal shapes, organic shapes such as those defined with Bayesian surfaces. In an embodiment, a polygonal shape can facilitate relatively easier visualization of a capstan wrap angle, as disclosed more fully below. The overall shape of the housing can be designed in any shape and size suitable for the use for which it is intended. For example, the size and shape can be dependent on the size of the flexible tension member required for the load for which velocity control is desired. If the device is intended to be worn as a personnel descent controller for firefighters, utilizing a flexible tension member designed for typical loads of a firefighter and his or her equipment, the size and shape can be designed for relatively compact attachment to the firefighter's safety harness, turn-out gear, self-contained breather apparatus, or other attachment, and can be nominally about 3 inches in diameter. While overall size of device 10 is not limited, in general, for personal, harness-attached uses, the largest dimension of a face of the housing 12, for example the diameter D as shown in FIG. 1, can be from about 1½ inches to about 6 inches. Likewise, if the shape of the housing were a generally rectangular box shape, the largest side dimension of the housing could be from about 1½ inch to about 6 inches. In an embodiment the largest dimension of a face of the housing can be from 2 inches to about 4 inches. In an embodiment, the largest dimension of a face of the housing can be from about 5 inches to about 16 inches. In like manner, a housing width, W, as measured from an external surface of chassis 16 to an external face of housing cover 14 can be from about 0.5 inches to about 6 inches, and can be from about 1 inch to about 3 inches. Larger dimensions, while potentially not convenient for wearable personal emergency use can be utilized.

Figure 2:
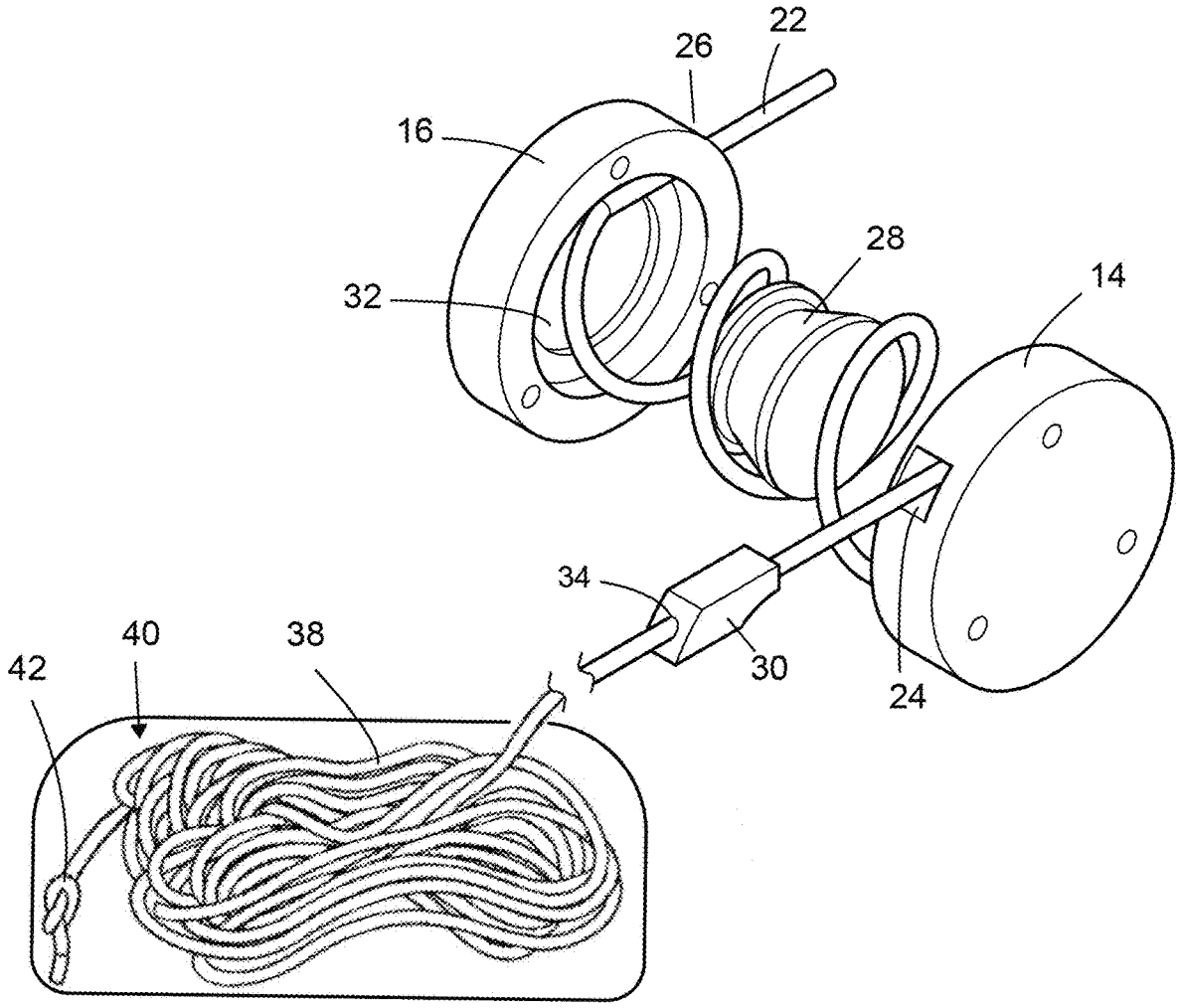
FIG. 2 is an exploded perspective view of a controlled descent device according to one embodiment.

The housing cover 14 can be joined to chassis 16 in any suitable manner. As described more fully below, it can be desirable for the housing cover 14 to be attached to the chassis 16 in variable positions. The housing cover 14 can be joined to chassis 16 by one or more screw connections 18, as shown in FIGS. 1 and 2. Housing cover 14 can also be joined to chassis 16 by mechanical, chemical, metallurgical, autogenous, adhesive connection, weld connection, clamping, press fit, and the like.

The housing 12 can be made of any material of suitable durability for the conditions of the intended use of the controlled descent device 10. In an embodiment the housing can be made any suitable engineering structural material such as, but not limited to materials including polymers, metals, ceramics, fiberglass, carbon fiber, or organics such as wood.

The housing 12 can have on an outer periphery 20 thereof two openings through which a flexible tension member 22 can pass through during operation: an entry aperture 24 and an exit aperture 26. The flexible tension member 22 can be, but is not limited to, an organic or polymer-based fiber cord, rope, cable, webbing, coated cables, carbon fiber, composite material, homogenous material such as a steel band, or other flexible load bearing line suitable for the application. The size and type of flexible tension member 22 can be selected for the conditions of the intended use of the controlled descent device 10. For use as a personnel descent controller for firefighters, for example, the flexible tension member 22 can be any tension member certified by the National Fire Protection Association (NFPA), or equivalent international regulatory body, such as Conformité Européene (CE) in Europe. As discussed more fully below, the size and shape of the entry aperture 24 and the exit aperture 26, as well as the size and shape of the throttle 30, described more fully below, can be determined by the cross-sectional dimension, e.g., the diameter, or stiffness of the flexible tension member used with the controlled descent device 10.

Turning now to FIG. 2, the controlled descent device 10 is further described with regard to the capstan 28 and a throttle 30. As can be understood from FIG. 2, which shows certain components of the descent device "exploded" to more fully show internal components, the chassis 16 defines a cavity 32 in which is disposed the capstan 28 and a portion of the flexible tension member 22 wrapped at least partially around capstan 28. Chassis 16 can define a cavity 32 of sufficient size and depth such that all or a portion of the capstan 28 is disposed within chassis 16. However, in an embodiment, a portion of housing cover 14 likewise defines a portion of cavity 32 and when the housing cover 14 is joined to chassis 16 a portion of the capstan 28 is disposed in the chassis 16 and in the housing cover 14. As disclosed herein, the capstan 28 is substantially enclosed within cavity 32. Such enclosure can ensure safe and reliable operation of the device by preventing the capstan from being exposed to damage. However, in an embodiment, the capstan can be exposed. In an embodiment, either of chassis 16 or housing cover 14 can provide for partial coverage of capstan 28. In an embodiment, housing cover 14 can be eliminated, and throttle 30 can be provided on an extension of chassis 16.

Throttle 30 is sized to both fit securely into entry aperture 24 and, as well, have an interior aperture 34 through which flexible tension member 22 passes, the interior aperture 34 being sized appropriately to be a first-stage energy transformer, as discussed in more detail below. In an embodiment, the energy being transformed is kinetic energy of a descending load, and the energy is transformed primarily into heat. Additionally, in the process of converting kinetic energy to heat, in an embodiment the throttle 30 can change dimensionally, such as through thermal expansion of a bimetallic actuator, thus providing a certain amount of closed-loop feedback control.

In operation, flexible tension member 22 can be anchored to a relatively fixed location by an anchor 36 which can be any suitable configuration of the flexible tension member or additional apparatus. For example, the anchor 36 can be a simple loop of the flexible tension member at a first end of the flexible tension member 22, with the loop being adapted to be secured to a relatively fixed location, such as to a post or beam in a building. The anchor can be, or can incorporate, any of hooks, grapples, or the like intended for fixedly attaching to a relatively fixed location. For example, anchor 36 can be a loop of the flexible tension member completed by a clip, carabiner, axe, or other firefighting equipment, or the like after being wrapped around a beam of a building. A portion of the flexible tension member 22, including the other, second, end of the flexible tension member 22 can be stored appropriately for use, for example in a coil 38 inside a storage compartment 40. In operation, the coil 38 can be any suitable arrangement that permits the flexible tension member to leave the storage compartment 40 during operation without bunching, or knotting up, and thereby preventing the flexible tension member 22 from traversing throttle 30 in the intended manner. Storage compartment 40 can be a bag, box, or other compartment in which flexible tension member 22 can be coiled for use. In an embodiment, a safety stop 42 can be disposed at the end of flexible tension member 22 so that if the entire length of flexible tension member attempts to pass through throttle 30, the safety stop 42 would prevent any further motion of the flexible tension member 22 through the bottle 30, thereby effectively preventing the flexible tension member 22 from becoming detached from the housing 12.

Figure 3:
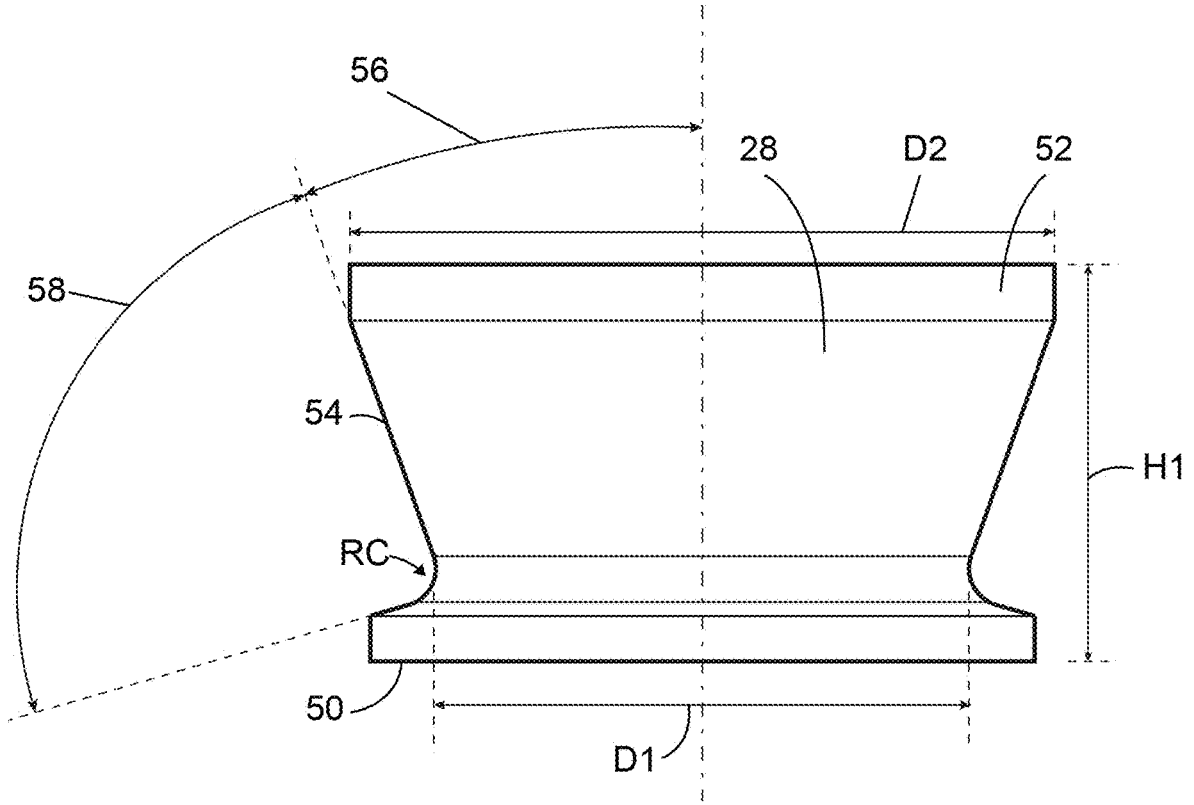
FIG. 3 is side elevation view of a capstan according to one embodiment of a controlled descent device according to a first mode of operation.

Turning now to FIG. 3, there is illustrated a schematic of a representative capstan 28. Capstan 28 can be, but is not limited to, a radially symmetric shape, such as the frustum of a cone. Radial symmetry can be useful because of the relative ease of manufacture, as well as the inherent strength of such a shape. The capstan 28 can have a proximal face 50 that can be joined to or integral with the inner surface of chassis 16, and a distal face 52 a distance H1 from the proximal face 50. The capstan 28 can have, but is not limited to, a peripheral surface 54 having a shape which can be defined as that of a frustum of a cone. As shown in FIG. 3, peripheral surface 54 defines a general linear, conical shape, but the peripheral surface can have complex, non-linear radial geometry. That is, the peripheral surface 54 can be non-symmetric or symmetric and could include non-linear forms such as parabolic or even exponential curvature. As described herein, when the flexible tension member 22 is wrapped around the peripheral surface 54, the tendency of the flexible tension member 22 is to be urged into the smallest diameter indicated as D1 in FIG. 3. The smallest diameter D1 occurs at a radius having a radius of curvature RC that is configured for the type and size of flexible tension member 22 used in the device 10. In an embodiment, the taper of the peripheral surface 54 is determined by a taper angle 56, and the radius of curvature RC can be limited in extent by the included angle 58. In an embodiment, for a flexible tension member having a circular cross-section, e.g., a rope, the root radius of curvature RC can be but is not limited to about ½ the average diameter of the tension member. The various capstan 28 features, including distance H1, the diameter D1, the radius of curvature RC and the taper angle 56 and the included angle 58, and total volume of material used in the capstan, can be specified to control the effective force gain in the flexible tension member 28 wrapped about capstan 28. These geometries, among others, may be specified in addition to wrap angle to optimize controlled descent velocity. Where "wrap angle" describes an angle swept by the flexible tension 22 member when at least partially wound around the capstan 28, and which can be in a helical configuration.

The capstan 28 peripheral surface 54 can have a surface finish and hardness sufficient to provide for a coefficient of friction and wear properties for the particular flexible tension member 22 utilized. The surface finish can be established by the manufacturing process itself, or provided with a post-machining treatments such as grinding, abrasive cutting, polishing, lapping, abrasive blasting, peening, honing, electrical discharge machining, milling, lithography, industrial etching, chemical milling, laser texturing, chemical etching, anodizing, nitriding, In general, the surface finish of peripheral surface 54 can have visually-discerned disruptions, such as those produced by knurling or dimpling, such as can be found on golf balls.

The capstan 28 can be made from any suitable material including metal. As discussed above the peripheral surface 54 can be machined or otherwise manipulated to a finish that serves to allow the flexible tension member to slidably traverse the peripheral surface 54 at a controlled rate when the controlled descent device 10 is in operation. The capstan 28, having an asymmetrical peripheral service 54, serves to urge the flexible tension member 22 toward the smallest diameter D1. When more than one wrap of flexible tension member 22 is wrapped around the peripheral surface 54 of capstan 28, it can be appreciated that adjacent wraps of flexible tension member 22 tend to press upon each other as each is being urged toward diameter D1. This urging of adjacent wraps to the smallest diameter D1 causes adjacent wraps to frictionally engage one another, such that in operation as the flexible tension member traverses the peripheral surface 54, the capstan serves as a second stage energy transformer. As discussed in more detail below, this energy transformation can tend to amplify the retarding force generated in the throttle 34, which serves as first stage energy transformer.

In an embodiment, additional energy transformation stages can be utilized, for example energy transformation pre- or post- the disclosed device. The capstan 28 operates to produce a system mechanical gain, such that when a payload is attached to the controlled descent device 10 and the payload and the controlled descent device 10 begin to descend such that the flexible tension member 22 begins to enter the controlled descent device 10 through the entry aperture and traverse the capstan 28, a relatively small oppositely directed force on the flexible tension member 22 at the entry aperture 24 can effectively limit, including slowing, and including stopping, the descent of the payload connected to the controlled descent device 10. Thus, the number of complete or partial wraps of the flexible tension member 22 about capstan 28 produces a quantifiable mechanical advantage. The controlled descent device 10 can be designed for a predetermined load by constructing the controlled descent device 10 to have a predetermined number of wraps or partial wraps of the flexible tension member 22 about the capstan 28, and having throttle 30 designed to "fine tune," so to speak the operation of the controlled descent device, as disclosed more fully below. Thus, the throttle 30 can serve as a first energy transformer by frictionally engaging the flexible tension member. The throttle 30 can also operate by other methods, direct or indirect, such as would be achieved with a counter-tapered throttle with an adjustable diameter or by non-contact velocity detection, or by eddy current braking in the flexible tension member 22 as it passes into the controlled descent device 10.

Mathematically, the operation of the controlled descent device 10 can be considered in the context of the drag force the device produces on flexible tension member during operation. For example, as discussed below, in one mode of operation, flexible tension member 22 can be anchored to a relatively fixed position on a building, and the controlled descent device 10 can be attached to a harness of a firefighter. In this mode of operation, the descent will be controlled within a velocity range, when the drag force on flexible tension member 22 between the controlled descent device and the anchor point is ideally equal to the force of the load of the firefighter, or within an operating window proportional to the allowable velocity range. The drag force $F_{drag}$ is a function of both the energy transformations that occur due to the opposing force of the throttle 30, $F_{throttle}$ and the opposing force due to design of the capstan 28, $F_{capstan}$, the type of flexible tension member 22, and the wrap angle of the flexible tension member 22 about capstan 28. The theoretical force equation in terms of θ and Θ can be expressed as:

$$F_{drag}=F_{throttle}*e^{\mu\Theta}$$

Where:

μ is the dimensionless coefficient of friction between the flexible tension member and the capstan Θ is the subtended angle in radians of the flexible tension member about the capstan As can be understood from the force equation above, a controlled descent device can be designed for a given load requirement ($F_{drag}$) by predetermining the coefficient of friction between the flexible tension member and the capstan, and by predetermining the number of wraps of the flexible tension member 22 about the capstan. Once these factors are determined, the nominal amplification factor is determined and the throttle force ($F_{throttle}$) can be set accordingly, to achieve the desired drag force ($F_{drag}$) on the system. In an embodiment, throttle 30 can be considered conceptually as a tube having a diameter and an internal surface area and surface configuration such that the coefficient of friction between the tube and the flexible tension member 22 provide the throttle force, $F_{throttle}$ which is amplified by the capstan 28.

In operation, therefore, controlled descent can be achieved when the load to be lowered is within a range of the drag force, $F_{drag}$ produced by the controlled descent device 10. As can be understood, if the load force equals $F_{drag}$ velocity will be constant. If the load force is not equal to $F_{drag}$, then a non-zero net force acts on the load. By Newton's second law (Force is the product of an object's mass and its acceleration), the sign sense of the net force determines acceleration or deceleration of the load. If the throttle force is variable, closed loop velocity control can be achieved by mechanical means or by electrically controlled adjustments. The controlled descent device 10 as described herein can, therefore, be adapted to a given expected load force, including by the end user, such as a firefighter. In an embodiment, a controlled descent device 10 can be provided for controlled velocity descent of firefighters within a defined weight range, over a defined velocity range. A controlled descent device can be designed for a particularly wide range of drag force, $F_{drag}$, through the use of wrap angle on the capstan 28. Such a capstan 28 can be more precisely controlled through the addition of a low drag throttle that produces a throttle force, $F_{throttle}$.

Figure 4:
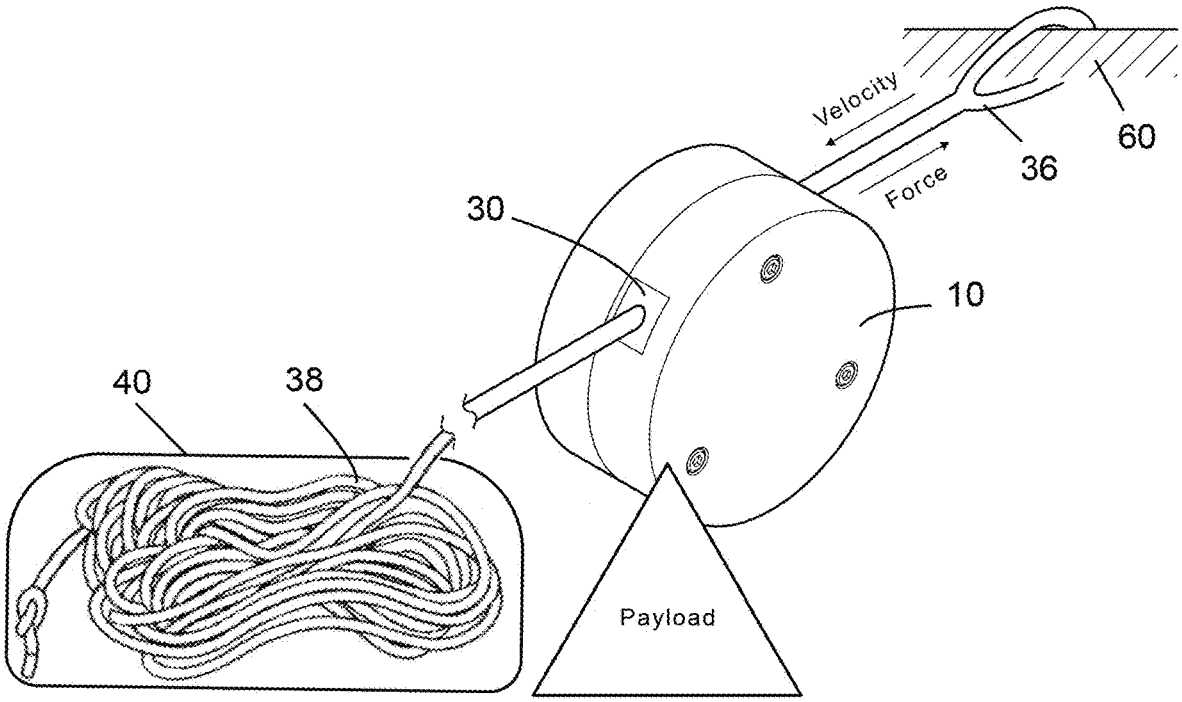
FIG. 4 is a schematic representation of a controlled descent device according to a first mode of operation.

Turning now to FIG. 4, one mode of operation is schematically illustrated, in which the payload is connected to the controlled descent device 10. In the mode illustrated in FIG. 4, the anchor 36 at a first end of flexible tension member 22 can be secured to a relatively rigid object, shown in FIG. 4 as reference object 60. In operation, controlled descent device 10 can be attached to a payload, which can be a person, for example by attaching in any suitable manner to a belt or harness. Thus, a firefighter can be the payload, and the firefighter can have attached to his or her harness or belt the controlled descent device 10. If the payload, for example the firefighter, becomes subjected to the forces of gravity in free fall, the controlled descent device 10 attached to the firefighter will begin to descend and the flexible tension member stored in storage compartment 40, such as in a coil 38 will begin to traverse through the interior aperture 34 of throttle 30 in which some energy is transferred to heat and distributed to the throttle 30, the capstan 28 and flexible tension member 22, in some proportion. The energy absorbed by the flexible tension member can be removed from the device, reducing the heat transferred to the capstan 28, allowing safe operating temperatures during descent. As the payload with the attached controlled descent device 10 continues to be attracted to the ground by the force of gravity, in effect flexible tension member 22 continues to be drawn into controlled descent member 10, around capstan 28 and exit at exit aperture 26. In the process of operation, capstan 28 as a second energy transformer transforms more kinetic energy to heat, and distributes it to the capstan 28 and flexible tension member 22, in some proportion. Because of the two energy transformations and the design of the controlled descent device 10, the payload with the controlled descent device 10 attached thereto can descend in a controlled velocity range, In practice, the desired velocity can vary within a range, and can be predetermined to not exceed a defined upper limit.

Figure 5:
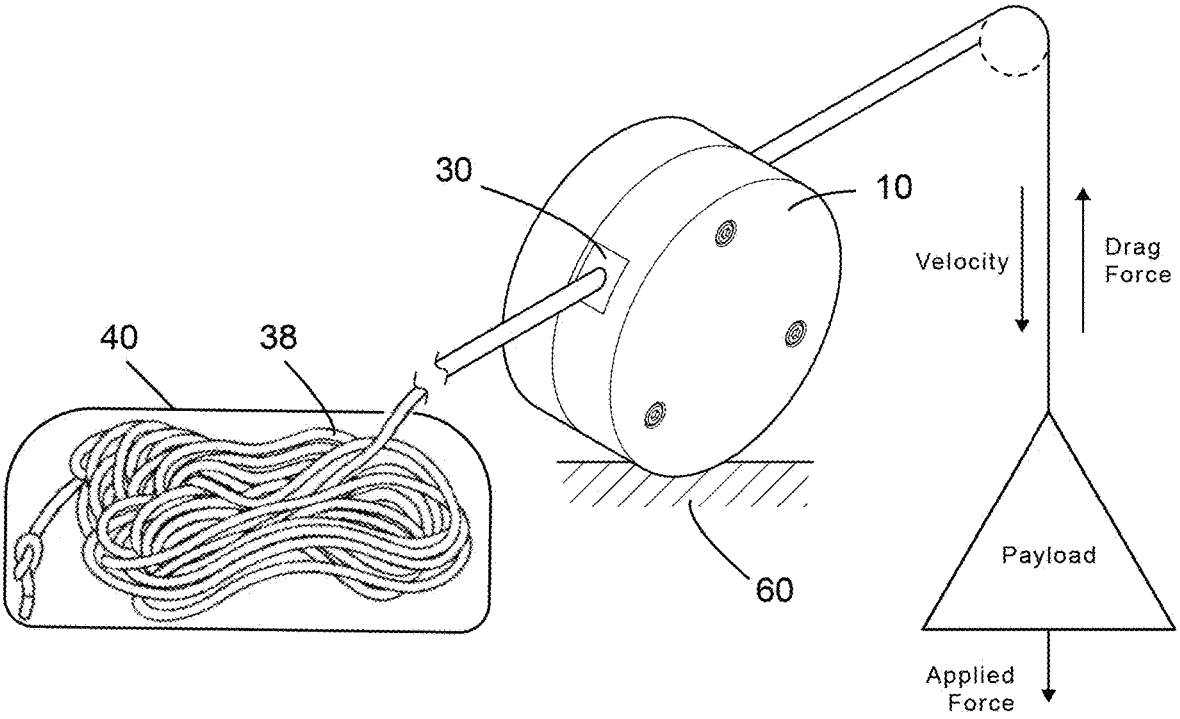
FIG. 5 is a schematic representation of a controlled descent device according to a second mode of operation.

FIG. 5 shows a similar operation of the controlled descent device 10 as in FIG. 4, but in a different configuration in which the controlled descent device 10 is secured immovably to a reference object. In the configuration shown in FIG. 5 the anchor 36 of the first end of flexible tension member 22 is secured to the payload, for example a firefighter dropping in free fall from an upper elevation of a building. The storage compartment 40 and coil 38 of flexible tension member 22 can be operable near the control descent device 10. As the payload, such as the firefighter, is drawn towards the ground by a gravity, the flexible tension member 22 is drawn into the controlled descent device 10 through throttle 30 in which some kinetic energy is transferred to heat, and distributed to the throttle 30, the capstan 28, and flexible tension member 22, in some proportion. Again, because of the two energy transformations, and the design of the controlled descent device 10, the payload can descend in a controlled velocity manner.

Therefore, it can be seen that the drag force, $F_{drag}$, imparted on the payload, which is the force that prevents the payload from free falling, and keeps the payload moving within a controlled velocity range, is proportional to the portion of the drag force imparted by throttle 30 and the amplification thereof, achieved by the wraps of the flexible tension member 22 on the capstan 28, the coefficient of friction between the flexible tension member 22 and the capstan 28, and by other design features as described herein. Moreover, the descent velocity can be controlled by changes to the throttle 30 design and or to the capstan 28 design and/or number of wraps of the flexible tension member 22 on the capstan 28, and the effective coefficient of friction between the flexible tension member 22 and the capstan 28. The mechanical gain achieved by the capstan 28 can be adjusted by, but is not limited to, changing the wrap angle of the flexible tension member 22. In operation the wrap angle may be adjusted by the user or by feedback mechanisms during a descent, or it can be set prior to use, for example in a "factory setting" for a given payload, or for a range of payloads.

In an embodiment, wrap angle on the capstan 28 can be manipulated by changing the configuration of housing cover 14 with respect to chassis 16. As can be understood, if housing cover 14 were to be rotated, exit aperture 26 is likewise rotated such that the wrap angle of flexible tension member 22 is changed. In this manner, the wrap angle can be substantially infinitely variable. In an embodiment, for example, the attachment of housing cover 14 to chassis 16 permits small incremental changes to the rotational position of exit aperture 26. For example, housing cover 14 can be attached to chassis 16 by a central bolting mechanism, thereby permitting free rotation of housing cover 14 with respect to the chassis 16 prior to bolt tightening. In an embodiment, the mating surfaces of the housing cover 14 and chassis 16 can have complementary "toothed" or notched portions that help maintain the desired position of housing cover 14 with respect to chassis 16 after attachment.

In addition to wrap angle, there exist a number of physical attributes of the capstan that are not user adjustable, but none the less can be used to change the mechanical gain profile of the system. Without being bound by theory, it is believed that the capstan diameter, taper angle, included angle, radius of curvature of the root, coefficients of friction, heat transfer coefficient, surface finishes, materials, and volume of material, can be selected depending on the load intended to experience a controlled descent under varying environmental conditions, such as in the presence of water, retarding liquid, powder or foam.

Without being bound by theory, it is believed that increasing the diameter of the capstan increases the mechanical gain by reason of increased contact area between the flexible tension member 22 and the peripheral surface 54 of the capstan 28. It is also believed that increasing the radius of curvature RC of the root of the capstan 28 decreases the mechanical gain by reason of decreased contact stress between the flexible tension member 22 and the capstan 28 peripheral surface 54. It is believed that increasing the taper angle 56 of the capstan 28 increases the mechanical gain by two distinct mechanisms. First, by increasing the lateral force that the flexible tension member 22 applies between adjacent wraps. Second, by increasing the relative motion between the flexible tension member and itself. The combination of lateral force and relative motion between the flexible tensile member and itself, allows manipulation of the energy transfer ratio between capstan 28 the flexible tensile member 22. Further, it is believed that increasing the included angle 58 of the capstan 28 increases the gain by reason of increased contact area between the flexible tension member 22 and capstan peripheral service 54. Yet to be determined interactions between these parameters may result in further refinement of advantageous behaviors which allow the device to operate in a stable region of the device's response surface.

Figure 6:
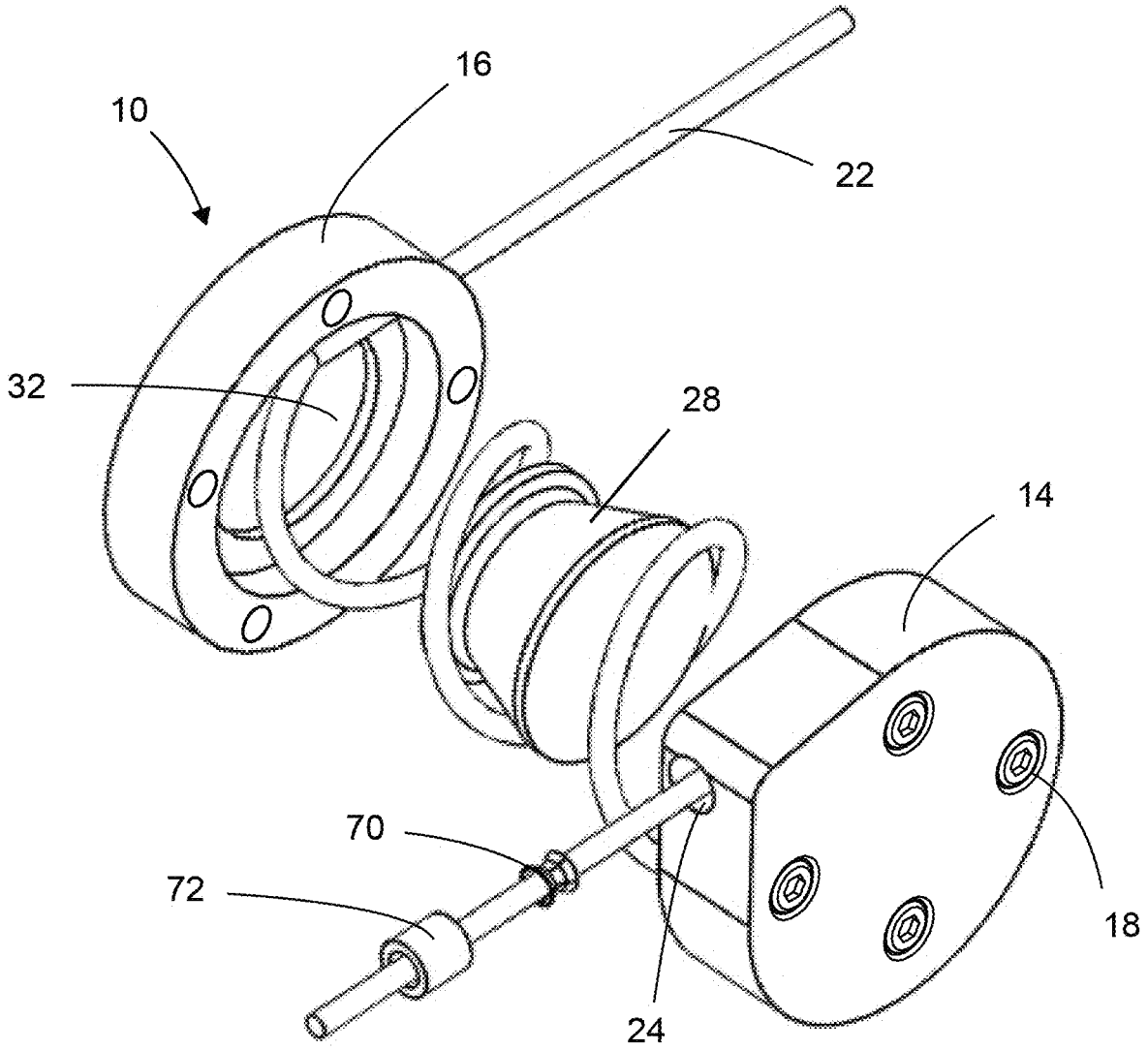
FIG. 6 is an exploded perspective view of a controlled descent device according to one embodiment.

Turning now to FIG. 6, another embodiment of a controlled descent device 10 is described. The embodiments described with respect to FIGS. 6-16 describe an embodiment of a controlled descent device 10 having a variable throttle and the related benefits derived from a variable throttle and related structure. The variable throttle embodiment can be utilized with any of the components of the controlled descent device 10 described above. Referring to FIG. 6, there is shown an "exploded" view of a variable throttle device to more fully show internal components and shows certain common components of the descent device as described above. For example, as described above, the chassis 16 can define a cavity 32 in which is disposed a capstan 28 and a portion of a flexible tension member 22 wrapped at least partially around capstan 28. Chassis 16 can define a cavity 32 of sufficient size and depth such that all or a portion of the capstan 28 is disposed within chassis 16. However, in an embodiment, a portion of housing cover 14 likewise defines a portion of cavity 32 and when the housing cover 14 is joined to chassis 16 a portion of the capstan 28 is disposed in the chassis 16 and in the housing cover 14. As disclosed herein, the capstan 28 is substantially enclosed within cavity 32. Such enclosure can ensure safe and reliable operation of the device by preventing the capstan from being exposed to damage. However, in an embodiment, the capstan can be exposed. In an embodiment, either of chassis 16 or housing cover 14 can provide for partial coverage of capstan 28. In an embodiment, housing cover 14 can be eliminated, and throttle 30 can be provided on an extension of chassis 16.

The embodiment depicted in FIG. 6 differs from that shown in FIGS. 1 and 2 primarily in the throttle design, and components related to the throttle 30. As shown in FIG. 6, throttle 30 can be a variable throttle 70, and can have a tubular hour-glass shape through which flexible tension member 22 passes, with a smallest diameter being sized appropriately to be variable a first-stage energy transformer providing a certain amount of closed-loop feedback control, as discussed in more detail below. Variable throttle 70 can be secured in place in the housing 12, for example in cover 14, by a retainer 72, as shown in more detail below.

Figure 7:
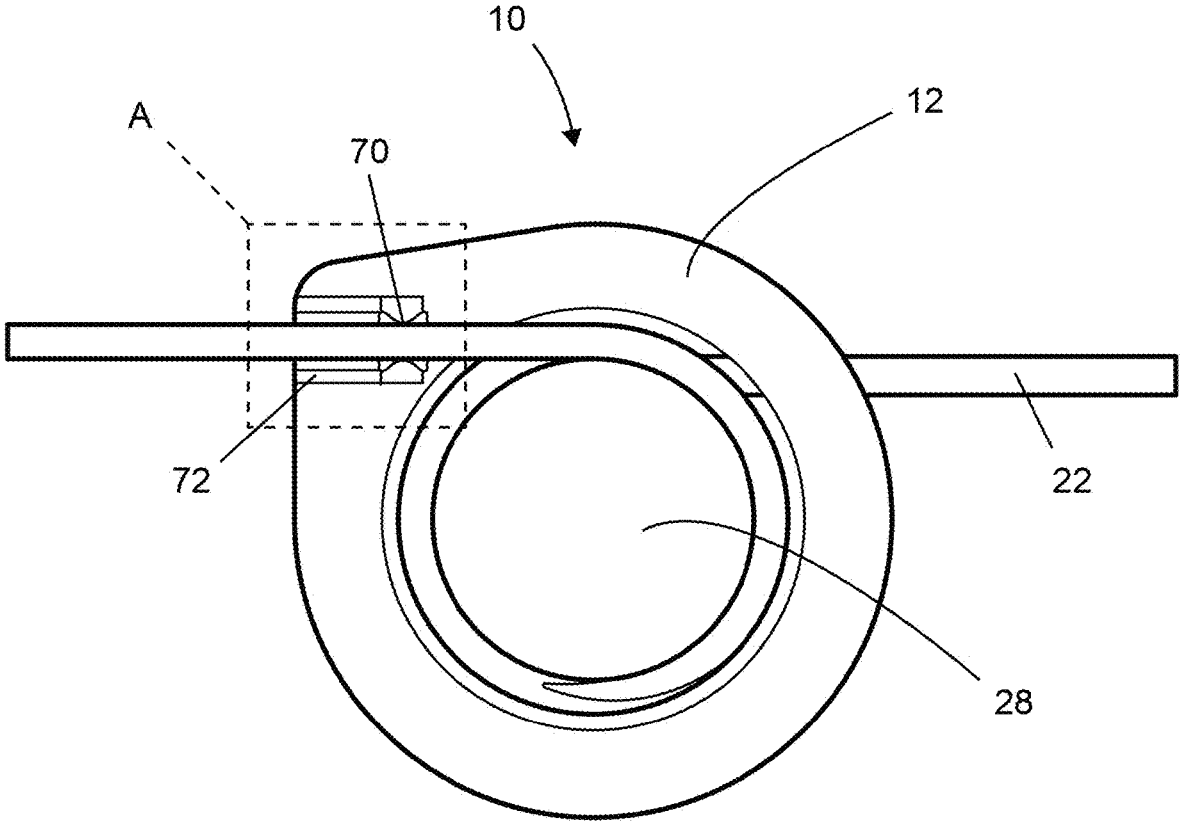
FIG. 7 is a cut-away side elevation view of a controlled descent device according to one embodiment.

FIG. 7 depicts a cutaway side elevation view of the controlled descent device 10 shown in FIG. 6. As shown, variable throttle can be secured in operable position with one end abutting a portion of housing 12, and the other end abutting retainer 72, which can be a tubular member secured into housing 12 and bottoming out on one end of variable throttle 70. A smallest diameter of variable throttle 70, that is the central portion thereof referred to herein as the throttle aperture 78, can be smaller than the outside diameter of flexible tension member 22, such that flexible tension member 22 can be compressed when passing through variable throttle 70. The compression of flexible tension member 22 during movement through variable throttle 70 can cause frictional heating that results in a dimensional change in the smallest diameter of the variable throttle 70, and a corresponding change in the retarding force supplied by the variable throttle 70 to flexible tension member 22, as discussed more fully below.

Figure 8:
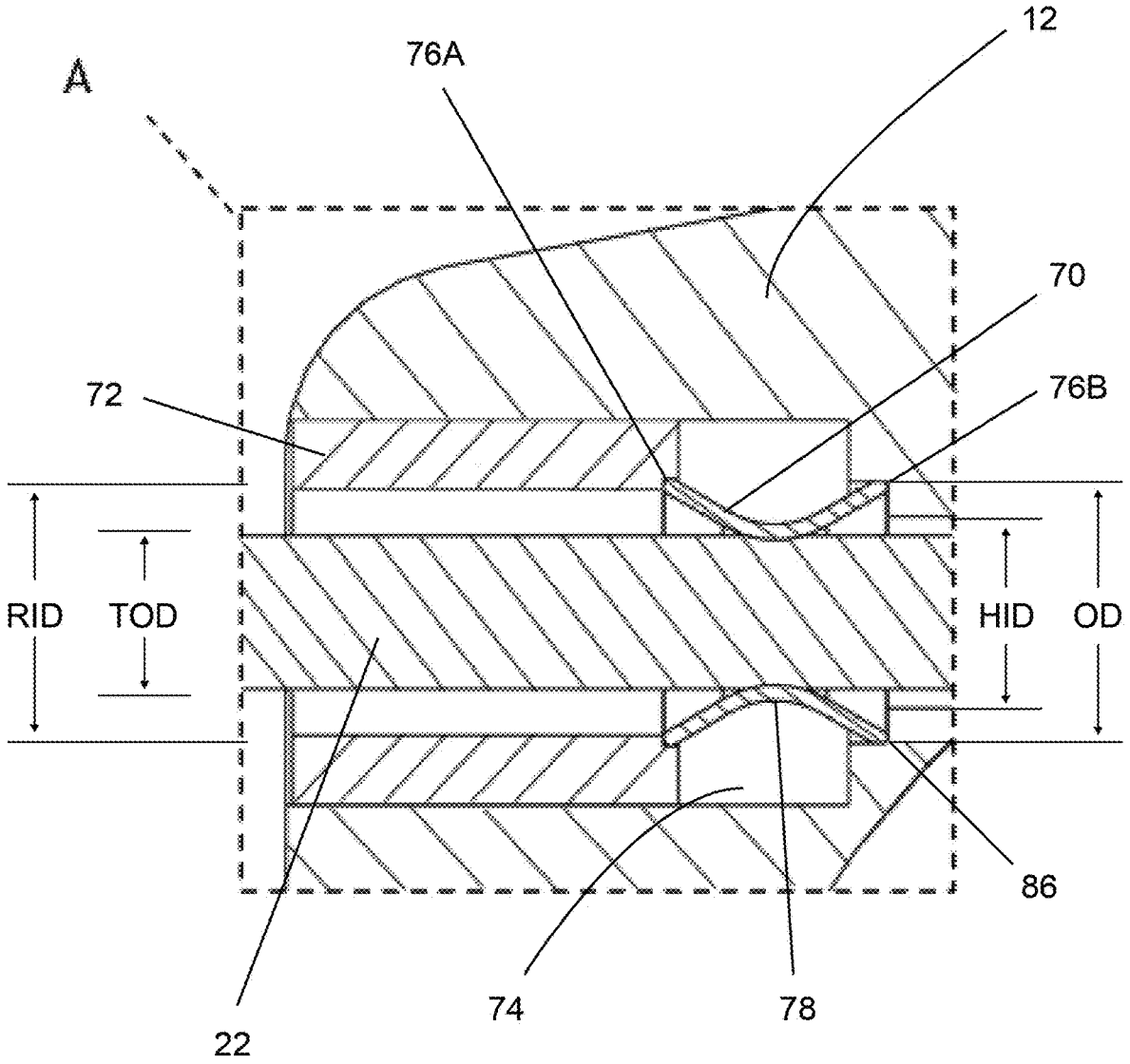
FIG. 8 is an enlarged cross-sectional view of the cut-away side elevation view of a controlled descent device shown in FIG. 7.

As shown in more detail in FIG. 8, which is a close up of area A in FIG. 7, retainer 72 can be any member that serves to secure variable throttle 70 in operable position. In an embodiment, retainer 72 can be a generally cylindrical tube having an inner diameter RID greater than the outside diameter TOD of the flexible tension member 22, such that flexible tension member 22 can pass freely through, i.e., without any frictional resistance, retainer 72. Retainer 72 can be made of metal, plastic, composite, or combinations thereof, and secured in housing 12 by press fit, welding, compression, adhesion, threaded connection, or combinations thereof. In an embodiment, retainer 72 can be metal and can have external threads that engage internal threads of housing 12 at entry aperture 24, and retainer 72 can be screwed into housing 12 until an interior portion thereof abuts variable throttle 70 on a first end 76A, and the variable throttle 70 can in turn can be forced into abutting a receiving portion 86 of housing 12 at a second end 76B. Retainer 72 can have a grooved or chamfered portion of the inner diameter in contact with first end 76A of variable throttle 70, such that first end 76A variable throttle 70 can be held securely from movement in an X direction, that is, the length of variable throttle 70 is fixed, and in a Y direction, that is, the outside diameter at first end 76A can be fixed. Likewise, second end 76B of variable throttle 70 can be secured against a portion of housing 12 that secures it from movement in an X direction, that is, the length of variable throttle 70 is fixed, and in a Y direction, that is, the outside diameter at second end 76B can be fixed. Thus, each end of variable throttle 70, including what can be generally circular peripheral surfaces thereof, can be seated in a relatively immobile position, secured between the retainer 72 and the receiving portion 86 of housing 12, such that movement due to thermal expansion in the X and Y directions is constrained at each end. A central portion of an hour-glass shaped variable throttle can have an inner diameter less the outside diameter TOD of the flexible tension member 22 and is referred to herein as the throttle aperture 78. And air pocket 74 can radially surround the throttle aperture 78, thereby tending to provide a layer of insulating air space that can serve to reduce heat transfer from the variable throttle 70 during operation.

In operation, as depicted in FIG. 8, as flexible tension member 22 is drawn through variable throttle 70 at a velocity, it is compressed as it passes through the smallest diameter of the variable throttle, and the resulting friction produces heat in both the flexible tension member 22 and the variable throttle 70. As heat builds up in the variable throttle 70, thermal expansion causes a dimensional change of the variable throttle 70. Because the variable throttle length and diameter is fixed at each end, 76A and 76B, any dimensional changes are forced into the central, narrowed portion, i.e., the throttle aperture 78. The dimensional changes can result in a decrease in the diameter of the throttle aperture 78, thereby causing an increase in the retarding force and a corresponding slowing of the velocity of flexible tension member 22 through variable throttle 70. As the velocity of flexible tension member 22 decreases, the corresponding reduction in heat production can cause a reduction in thermal expansion and an increase in the diameter of the throttle aperture, thereby allowing a corresponding increase in the velocity of flexible tension member 22. The description above holds for most materials of interest, including metals, in which the coefficient of expansion is positive. For some materials, such as certain ceramics, the coefficient of thermal expansion can be negative, resulting in a decrease in the diameter of the throttle aperture without being fixed at each end.

Figure 9:
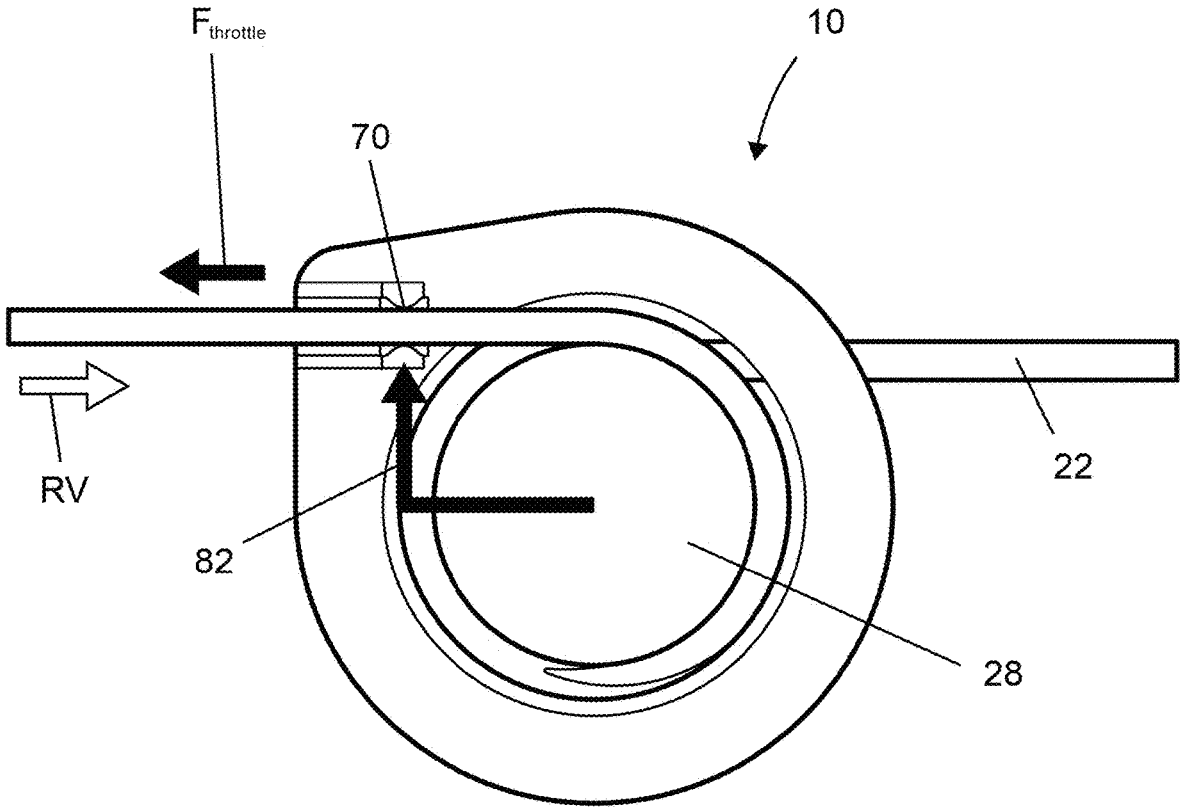
FIG. 9 is a cut-away side elevation view of a controlled descent device showing the operation of a controlled descent device according to one embodiment.

As can be understood from the above description, and with the following description referring to the diagram of FIG. 9, the controlled descent device 10 can incorporate two distinct stages of energy transformation, including a variable stage driven by kinetic energy of the descending load. The variable stage is a negative feedback loop that senses heat energy at the throttle aperture, reacting mechanically to reduce the velocity of the descending load. During descent of a load, as described above with respect to FIGS. 4 and 5, the flexible tension member 22, which can be a rope, passes through the device 10 at a rope velocity RV, with a corresponding kinetic energy. Due to the compression of the flexible tension member 22 as it passes through the throttle aperture 78, some of the kinetic energy of the flexible tension member is converted into heat, and transferred into the variable throttle 70. Some heat is conducted to the variable throttle 70 and at least some of the heat can be carried away by the flexible tension member. The heat conducted to the variable throttle 70 results in a temperature rise and, for materials having a positive coefficient of thermal expansion, causes a volumetric increase of the variable throttle 70. The volume increase is a function of the coefficient of thermal expansion and change in temperature. For variable throttles, including hour-glass shaped throttles, if the variable throttle 70 is rigidly constrained on its end peripheral surfaces axially and radially, as described above, then the volumetric expansion of the variable throttle 70 results in a reduction of the diameter of the variable throttle 70 at a central location, referred to herein as the throttle aperture 78. As the throttle 70 expands volumetrically and its throttle aperture 78 is reduced, it is forced to further constrict the flexible tension member, that is, the normal force (aligned radially around the circumference of the flexible tension member) increases. The normal force multiplied by the coefficient of friction, generates a throttle force, $F_{throttle}$. $F_{throttle}$, therefore, can increase with increasing rope velocity RV, and can oppose a load force, thereby controlling the acceleration of the load. Specifically, the variable throttle 70 can beneficially reduce acceleration during descent of a load.

Further, in an embodiment, the capstan 28 can act as a second stage energy transformer, again converting a portion of the kinetic energy of the flexible tension member into heat. Some heat from the moving flexible tension member can be conducted to the capstan and some of the remaining heat in the flexible tension member can be carried away by the flexible tension member. The proportion of energy transformed from kinetic energy to heat energy is function of the capstan "gain" and throttle force, $F_{throttle}$. As discussed above, the gain of the capstan 28 can be manipulated by modifications to its geometry (diameter, cone angle, surface finish, material, total material volume etc.) and the wrap angle of the flexible tension member around the capstan.

In an embodiment, heat stored in the capstan may be transferred from the capstan to the throttle by means of a thermal conductor 82. For example, a metallic conduit, shown schematically as 82 in FIG. 9, may connect the capstan and the variable throttle, such that heat can be conducted between the two components. The metallic conduit can be, for example, a copper wire attached at one end to the capstan and to the other at or near the variable throttle. The additional energy delivered to the throttle can further constrict the variable throttle aperture 78 and increased throttle force, $F_{throttle}$, which can be amplified by the gain of the capstan, thus resulting in increased load force and ultimately reduced velocity. Differential thermal expansion of the throttle 70, relative to the housing 12 and retainer 72, can be equilibrated prior to deployment by insulating the entire device, or controlling heat transfer in the device 10 via a thermal conductor 82 and material selection of the capstan 28, throttle 78, housing 12.

As can be understood from the description herein, the present disclosure discloses a way for a first stage variable throttle to adaptively increase the drag force on a flexible tension member as load velocity increases; thereby controlling velocity range of the descending load. The adaptive response of the throttle is powered by kinetic energy in the system, which is transformed into thermal energy (frictional heating) that is in turn delivered to the variable throttle.

Without being bound by theory, one way to explain the operation of the velocity control device of the present disclosure is with respect to the First Law of Thermodynamics $\Delta U=Q-W$, where U is the internal energy, Q is heat added to the system, and W is work done by the system, with the system being the controlled descent device including the flexible tension member. As heat is added to the system from the moving flexible tension member in frictional contact with the device components, the change in internal energy causes work to be done by the system in the form of drag forces that counteract the applied forces on the flexible tension member, such as the forces due to an object in free fall. Thus, in an embodiment, the controlled descent device can be described as a system in which Q (heat added to the system) causes W (work done by the system), the Q being added due to frictional contact between system components and a flexible tension member, and the W being drag forces induced in the system.

In an embodiment, where U is the internal thermal energy stored in the device components, a heat pipe such as a conductive element or device such as a Peltier junction, can be used to transfer energy between components. For example, the capstan 28 can store substantial internal energy, U, as an applied load descends. The internal energy U in the capstan 28 can be used to selectively heat or cool structures within the system, e.g., to affect throttle function and/or mitigate undesirable thermal variation in the system. Because the variable throttle length and diameter is fixed at each end, 76A and 76B, any dimensional changes are forced into the central portion, i.e., the throttle aperture 78. The dimensional changes can result in a decrease in the diameter of the throttle aperture 78, thereby causing an increase in the retarding force and a corresponding slowing of the velocity of flexible tension member 22 through variable throttle 70. Therefore, you can heat or cool the throttle 70 or the housing 12 to achieve a temperature differential suitable to control velocity.

In an embodiment, in addition to being described in the terms of the First Law of Thermodynamics above, the system can be described as operating with no moving parts outside of the flexible tension member moving through the device, and the movement of thermal expansion in certain components.

Metallic materials can have a positive coefficient of thermal expansion, thus in most situations the throttle aperture 78 will naturally increases with temperature, resulting in an increase in the diameter of the throttle aperture and a reduction in the throttle force, $F_{throttle}$, which is the opposite of the desired behavior of the present disclosure. A reversal of this expected behavior can be achieved by a combination of constraint of the ends of the variable throttle 70, as discussed above, and a throttle aperture 78 together with differential expansion between the throttle and its housing. As frictional heating from the flexible tension member is conducted into the throttle, the throttle can expand volumetrically, but it can be constrained axially and radially at each end. An hourglass shape of the variable throttle allows the throttle aperture 78 to nevertheless expand radially inwardly to impart a constricting force on the flexible tension member 22, e.g., the rope, thus increasing the drag force in the throttle on the flexible tension member. The coefficient of thermal expansion, thermal mass, throttle shape, number of slits and location of slits (as described below) can each play a role and allow the variable throttle 70 to produce a negative feedback loop which senses heat energy at the throttle aperture, reacting mechanically to reduce the velocity of the descending load.

Figure 10:
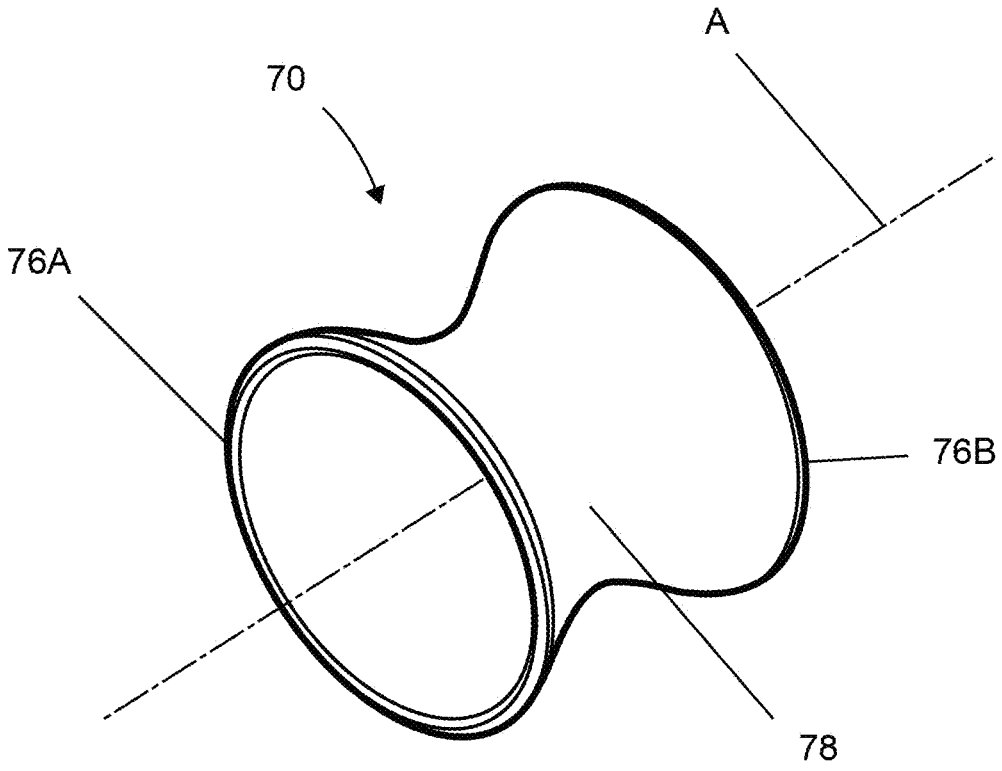
FIG. 10 is a perspective view of a throttle of the present disclosure.

Referring now to FIG. 10, there is shown one embodiment of a variable throttle 70. As shown, variable throttle 70 can be a tubular component in the shape of an hour-glass, with a first end 76A and a second end 76B. In general, the variable throttle need not be limited to a circular tubular shape having generally circular-shaped first and second ends, as shown in FIG. 10. Likewise, in general, the hour-glass shape need not be symmetrical along axis A, that is, the necked-down, throttle aperture 78 need not be centrally located between the first end 76A and second end 76B.

Figure 11:
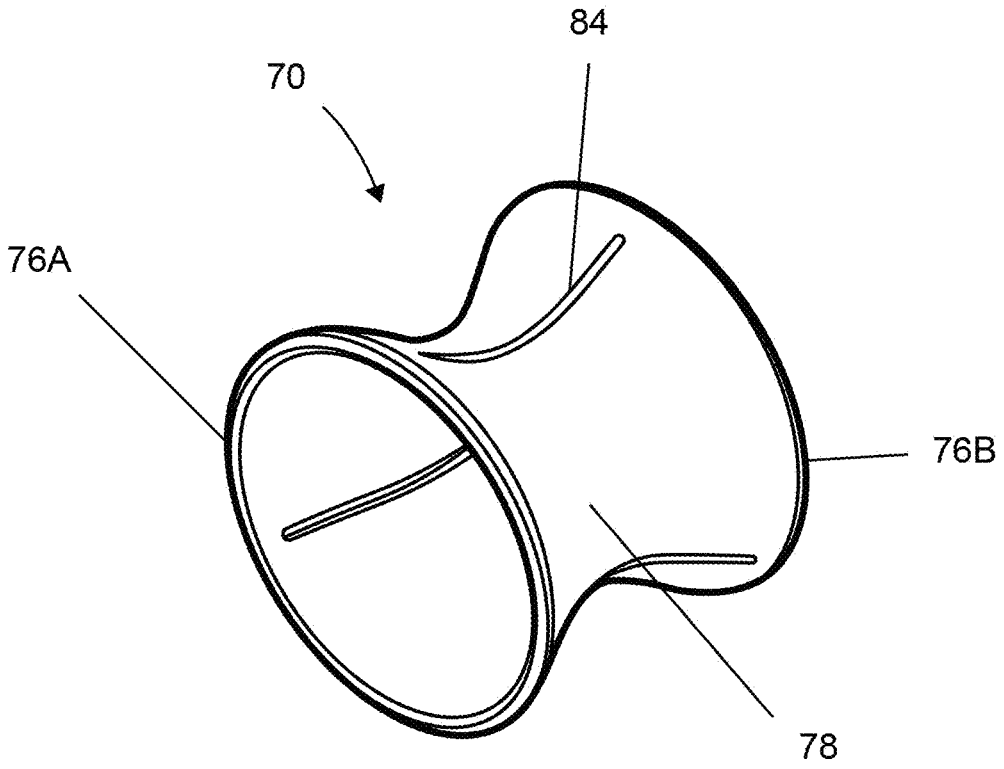
FIG. 11 is a perspective view of a throttle of the present disclosure.
Figure 12:
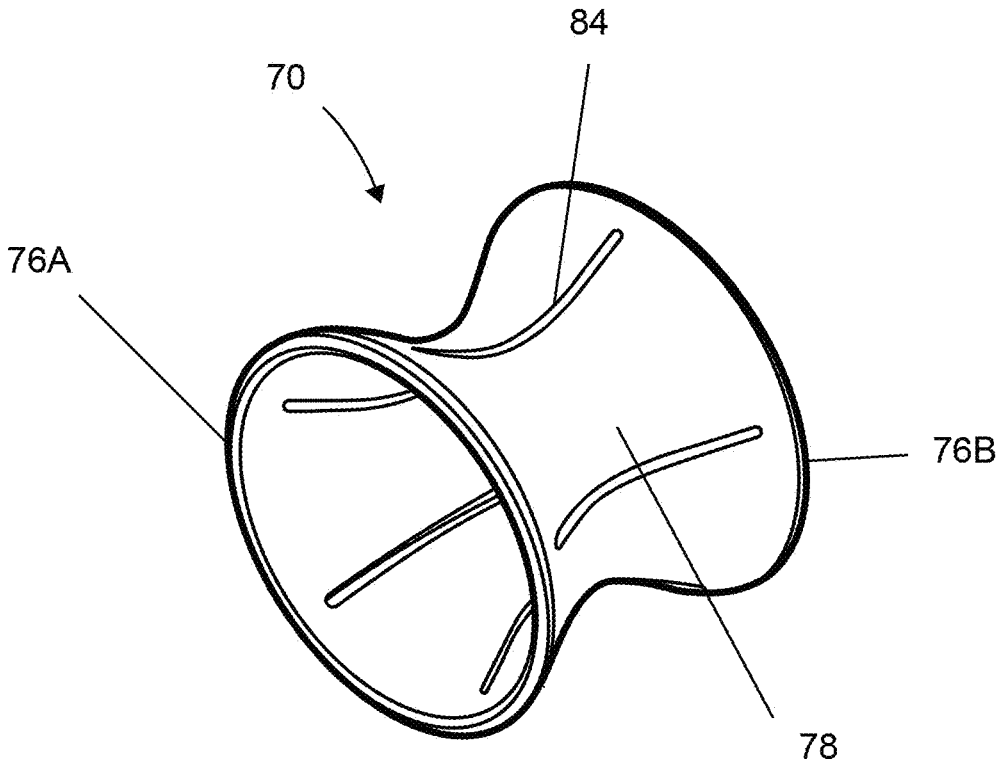
FIG. 12 is a perspective view of a throttle of the present disclosure.

It has been found that the throttle force, $F_{throttle}$, can be more readily created by adapting the variable throttle 70 with a plurality of slits 84, as shown in FIGS. 11 and 12. As depicted in FIG. 11 three slits 84 can be made in the tubular sidewalls of variable throttle 70. As depicted in FIG. 12 five slits can be made in the tubular sidewalls of variable throttle 70. In general, slits 84 can be made in the tubular sidewall of variable throttle 70 in any number and spacing that does not compromise the integrity of the variable throttle 70 during use, but it is believed that best results can be obtained with an odd number of slits between 3 and 9 spaced evenly around the circumference of variable throttle 70. As shown in FIGS. 11 and 12, slits 80 can be disposed in the throttle aperture 78 portion of the variable throttle 70, and they do not extend all the way to either first end 76A or second end 76B.

Without being bound by theory, it is believed that the presence of a plurality of slits 84 enhances the variable throttle 70 operation by more readily converting heat conducted to the variable throttle 70 to radially compressive forces on flexible tension member 22. As variable throttle 70 is heated by the conduction of heat generated by the frictional engagement of the flexible tension member 22 moving through variable throttle 70, the variable throttle material expands according to its coefficient of thermal expansion. Because the first and second ends of the variable throttle are mechanically fixed such that thermal expansion parallel to axis A of variable throttle 70 is limited, the thermal expansion occurs in the central portion of variable throttle 70, that is free to expand. Due, it is believed, to the hour-glass shape of variable throttle 70, the central portion, which is the throttle aperture 84, expands radially inwardly. Slits 84 permit relatively less resistance to radial inward expansion, as the material between the slits can expand more readily while tending to cause the slit width(s) to decrease. That is, the slit width for each slit can close, permitting thermal expansion of the portions of the throttle aperture 78 between the slits 84. As the throttle aperture 78 thermally expands and the slits widths narrow, the radially inward force of the throttle aperture 78 on the flexible tension member 22 causes greater restriction of the flexible tension member, which produces the throttle force TF described above.

Figure 13:
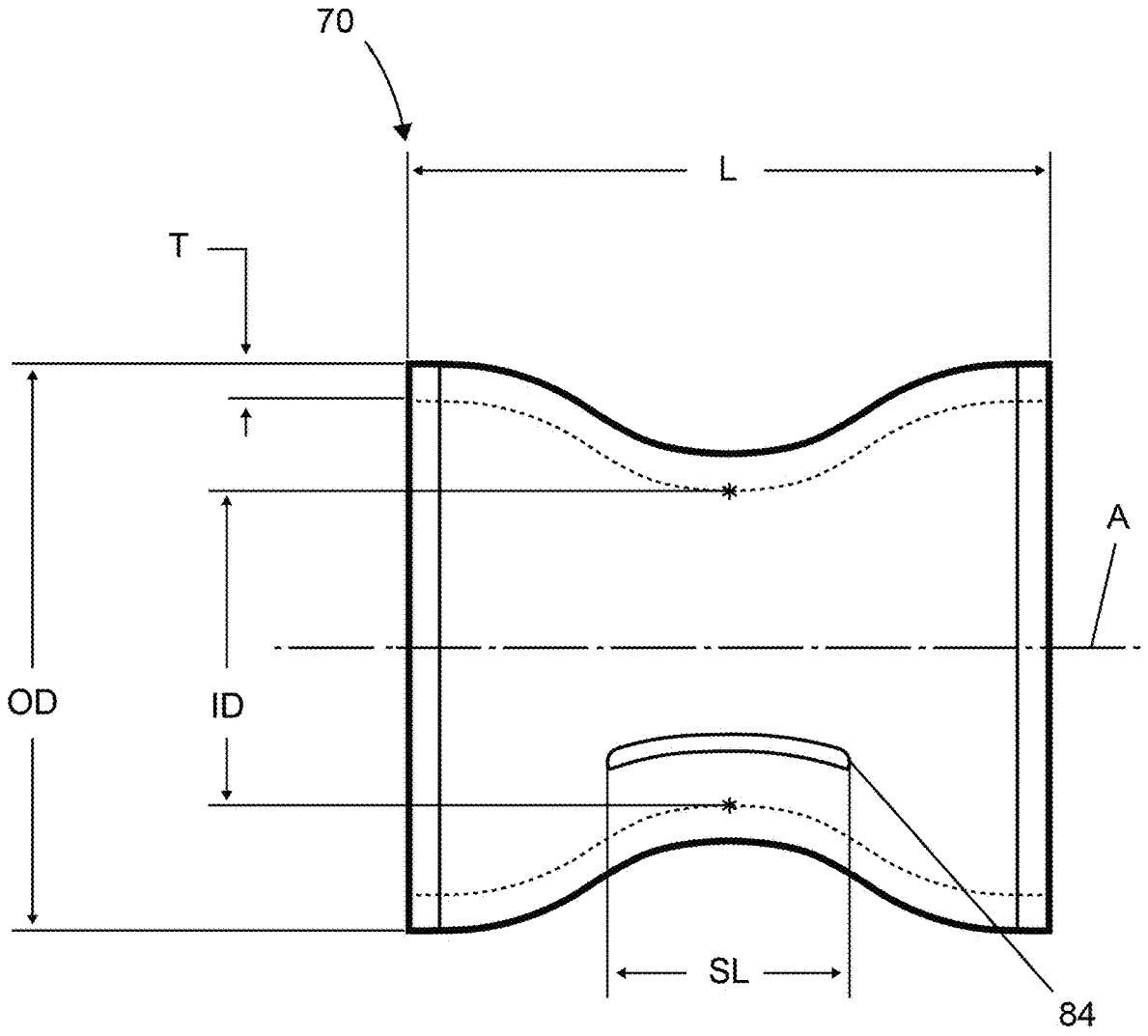
FIG. 13 is a side elevation view of a throttle of the present disclosure.
Figure 14:
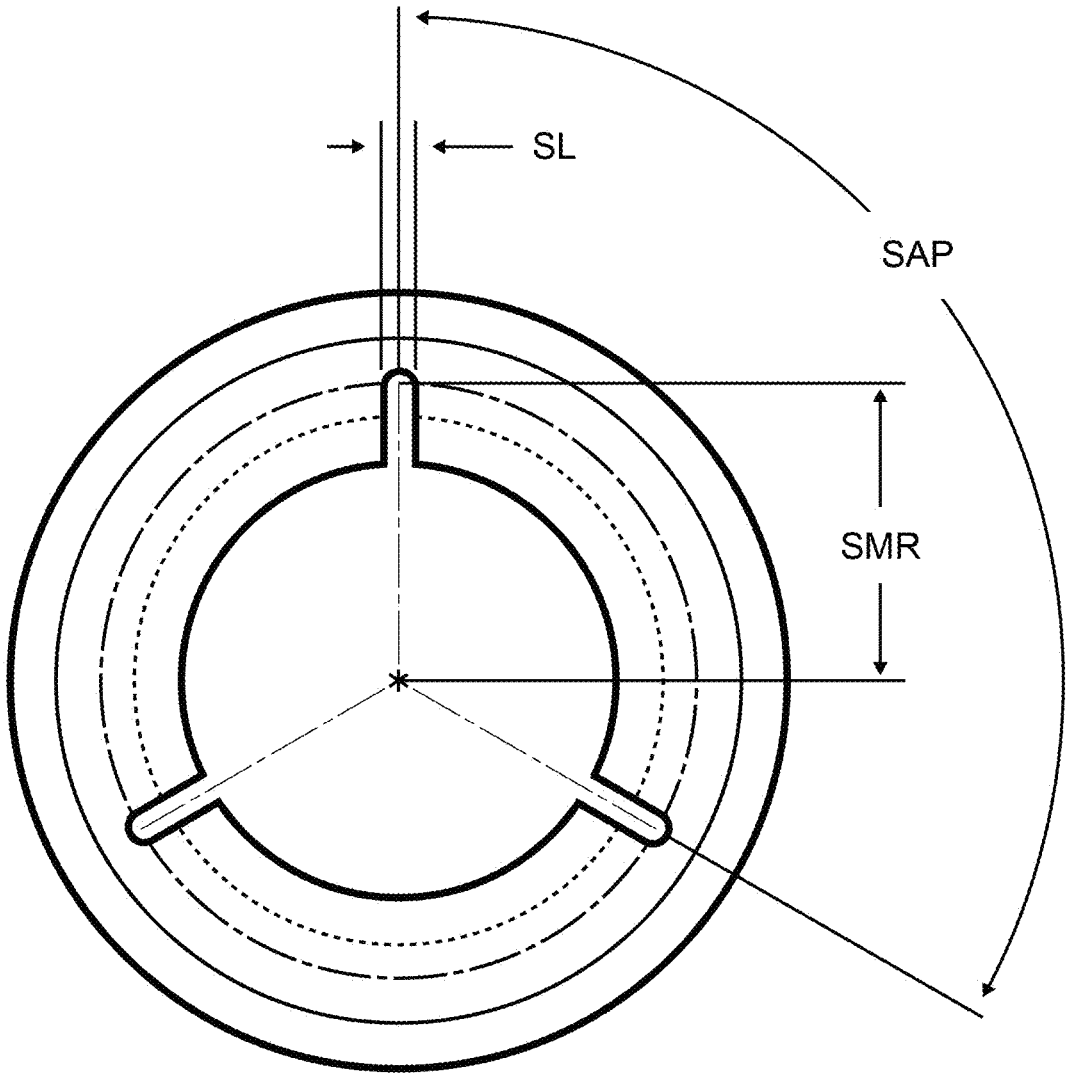
FIG. 14 is a front elevation view of a throttle of the present disclosure.

A side elevation view of a representative variable throttle 70 with three slits 84 is shown in FIG. 13. A front elevation view of the representative variable throttle 70 shown in FIG. 13 is shown in FIG. 14. The representative variable throttle shown in FIGS. 13 and 14 is described with representative dimensions below, but these dimensions are to be understood as nonlimiting, and are provided for a stainless steel variable throttle 70 for use with a flexible tension member 22 in the form of a flexible tension member having a diameter of about 0.230 inches, and for use with a load force in free fall under the influence of gravity of between about 50 pounds and about 300 pounds. A variable throttle 70 can have a throttle length L measured parallel to axis A of between about 0.250 inches and about 2 inches and can be 0.355 inches. The variable throttle can have a tubular wall thickness T of between about 0.010 inches and about 0.030 inches and can be 0.020 inches. In general, relatively thinner wall thicknesses can result in faster response times due to the relatively less thermal mass. The variable throttle can have an outside diameter OD of between about 0.275 inches and about 0.450 inches and can be about 0.326 inches. The variable throttle can have an inside diameter ID of between about 0.100 inches and 0.250 inches and can be between about 0.170 inches and 0.200 inches for a flexible tension member 22 (e.g., flexible tension member) diameter of 0.230 inches, for a 10% to 30% constriction of the flexible tension member 22 in throttle aperture 84. The slit 84 can have a slit length SL of between about XX and YY inches, and a slit width SW of between about 0.010 inches and about 0.020 inches and can be about 0.012 inches. The slits can be spaced at a slit angular spacing SAP to be equally spaced, for example an SAP of 120 degrees for the three-slit version, as shown. The ends of the slits can be a slit maximum radius SMR measured from axis A radially out to the end of the slit, of between about 0.090 inches to about 0.150 inches and can be about 0.125 inches.

Figure 15:
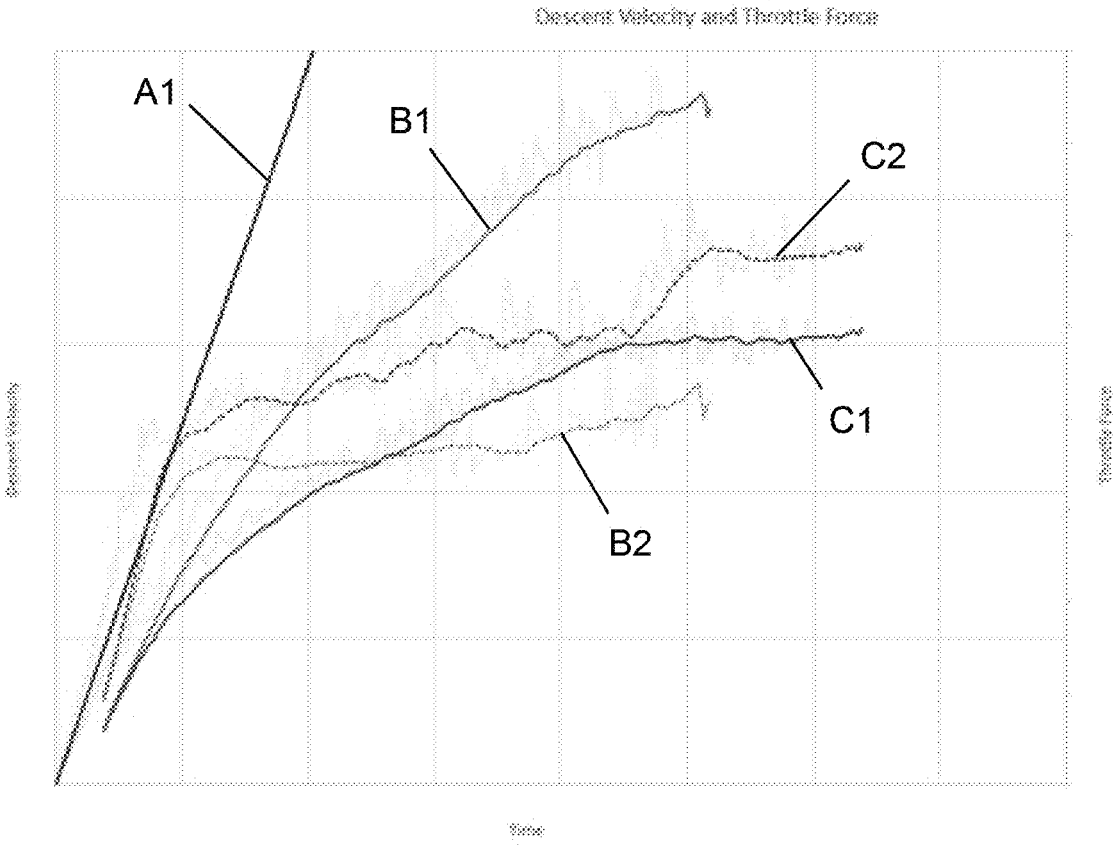
FIG. 15 is a graph showing certain data related to the operation of a controlled descent device of the present disclosure.

The variable throttle 70 performance in a controlled descent device 10 is illustrated in the measured in-use data shown in FIG. 15. The graph of FIG. 15 graphs both descent velocity, DV and throttle force, $F_{throttle}$ against time, showing relative response curves. Line A1 represents theoretical velocity of a load in free fall under the influence of gravity at 9.8 $m/s^2$. Line B1 represents the descent velocity of a variable throttle 70 having no slits 84. Line B2 represents the throttle force of a variable throttle 70 having no slits 84. Line C1 represents the descent velocity of a variable throttle 70 with slits 84. Line C2 represents the throttle force of a variable throttle 70 with slits 84. As can be understood from the data of FIG. 15, the descent velocity is significantly decreased relative to free fall with a variable throttle with or without slits, but the descent velocity is relatively more greatly decreased in a controlled descent device utilizing a variable throttle with slits. Likewise, the throttle force is significantly increased in a controlled descent device utilizing a variable throttle with slits, relative to a controlled descent device utilizing a variable throttle without slits.

Figure 16:
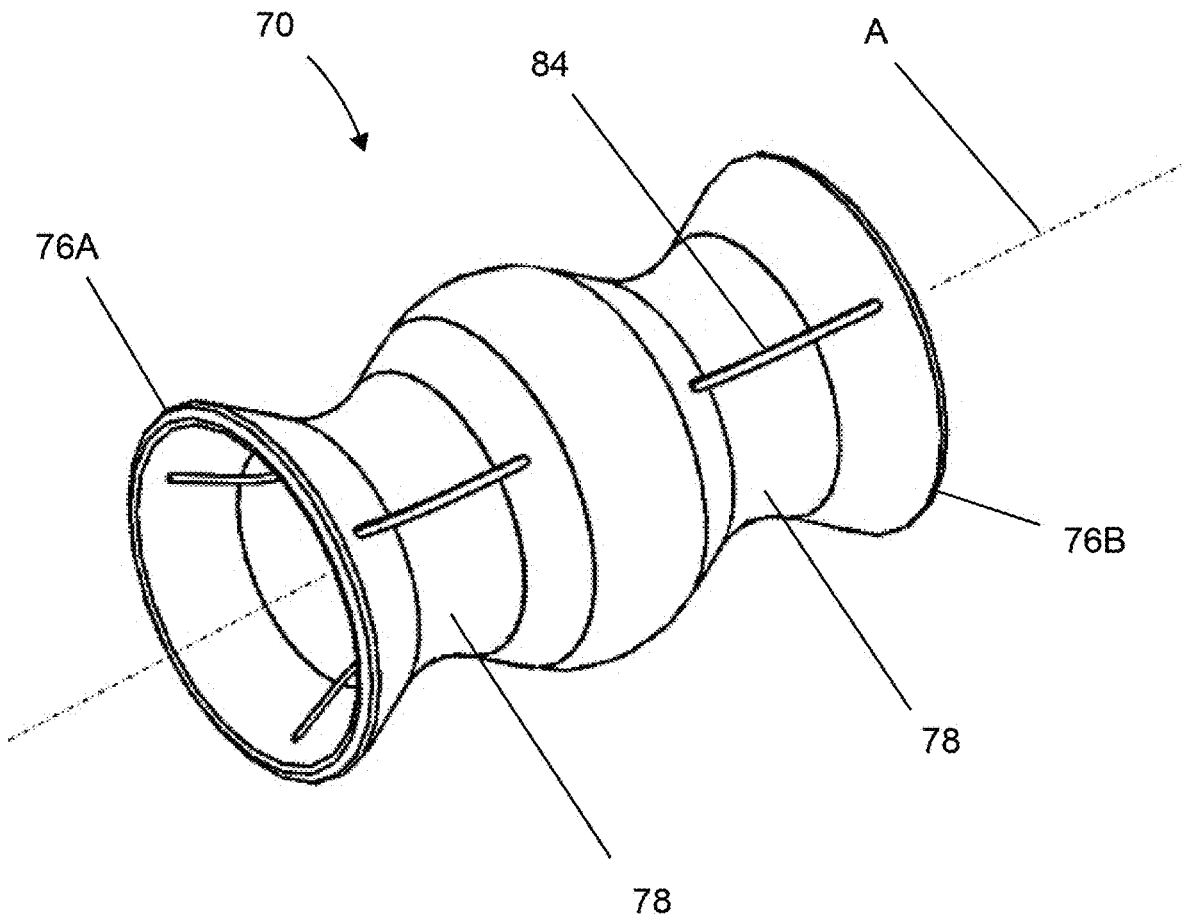
FIG. 16 is a perspective view of a throttle of the present disclosure.

The descent control device 10 can have a throttle or variable throttle as described above. In an embodiment, the descent control device 10 can include more than one throttle and/or variable throttle. In an embodiment, for example, two variable throttles 70 can be axially aligned and abut one another to provide for two throttle apertures 78 that flexible tension member 22 passes through. In an embodiment, more than two throttles, including variable throttles, can be aligned and utilized to provide a predetermined throttle force. In an embodiment, as shown in FIG. 16, variable throttle 70 can have two throttle apertures 78, and each throttle aperture can have, or not have, slits 84.

Many additional components and variations are contemplated. For example, the controlled descent device 10 can have any of known clips, buckles, straps, over-center clasp, or other means to attach to a user's belt, harness, or other safety equipment. In an embodiment, the controlled descent device disclosed herein can include as an integral part a belt or harness. In an embodiment it can be understood that the velocity of a load under the force of gravity can be adjusted, including slowed, by an additional retarding force on flexible tension member 22 prior to entering the throttle 30 of device 10. That is, an operator can physically manipulate, such as with a gloved hand or a twist of the body, the angle of entry of the flexible tension member, or, likewise, the operator can simply supply a slight "tug" to flexible tension member 22 as it plays into the device to affect a velocity change.

The foregoing description of embodiments and examples has been presented for purposes of illustration and description. It is not intended to be exhaustive or limiting to the forms described. Numerous modifications are possible in light of the above teachings. Some of those modifications have been discussed, and others will be understood by those skilled in the art. The embodiments were chosen and described in order to best illustrate principles of various embodiments as are suited to particular uses contemplated. The scope is, of course, not limited to the examples set forth herein, but can be employed in any number of applications and equivalent devices by those of ordinary skill in the art. Rather it is hereby intended the scope of the invention to be defined by the claims appended hereto.

What is claimed is:

1. A device for controlled velocity of a load under a tensioning force, the device comprising:

a. a chassis, the chassis having a portion of a peripheral surface thereof defining an exit aperture;

b. a capstan disposed upon the chassis, the capstan having a peripheral surface having a generally conical shape defining a varying diameter, the smallest diameter being disposed near the chassis in a root having a radius of curvature;

c. a housing cover joined to the chassis and at least partially enclosing the capstan, the housing cover defining an entry aperture, the entry aperture being a throttle; and d. wherein the housing cover is rotatable with respect to the chassis, whereby rotating the housing cover changes the relative position of the entry aperture relative to the exit aperture.

2. The device of claim 1, wherein the capstan is integral with the chassis.

3. The device of claim 1, wherein the capstan is integral with the housing cover.

4. The device of claim 1, wherein the chassis is made of a material selected from the group consisting of metal, polymers, ceramics and composites.

5. The device of claim 1, wherein the capstan is made of a material selected from the group consisting of metal, polymers, ceramics and composites.

6. The device of claim 1, further comprising a retainer, the retainer being fixed in the housing at the entry aperture and securing the throttle at a first end of the throttle.

7. A controlled descent device for use by a user, comprising:

a. a chassis, the chassis having an outer surface upon which is disposed a connection member for connecting to a safety harness of the user;

b. a housing cover joined to the chassis, the chassis and the housing cover defining a cavity in which is disposed a capstan, and a peripheral surface defining an entry aperture and an exit aperture;

c. a throttle, the throttle being disposed in operative relationship to the entry aperture, wherein the throttle is an hour-glass shaped tube; and d. wherein the housing cover is rotatably joined to the chassis, whereby rotating the housing cover changes the relative position of the entry aperture relative to the exit aperture.

8. The device of claim 7, wherein the capstan is integral with the chassis.

9. The device of claim 7, wherein the capstan is made of a material selected from the group consisting of steel, stainless steel, polymer, and composites.

10. The device of claim 7, further comprising a retainer, the retainer being fixed in the housing at the entry aperture and securing the throttle at a first end of the throttle.

* * * * *